US005957403A

United States Patent [19]

Pöppinghaus

[11] Patent Number: 5,957,403

[45] Date of Patent: Sep. 28, 1999

[54] APPARATUS AND METHOD FOR WINDING YARN IN A WILD WINDING ONTO A PACKAGE

[75] Inventor: Winfried Pöppinghaus, Bad Sooden-Allendorf, Germany

[73] Assignee: Georg Sahm GmbH & Co. KG, Eschwege, Germany

[21] Appl. No.: 08/946,111

[22] Filed: Oct. 2, 1997

[30] Foreign Application Priority Data

Oct. 16, 1996 [DE] Germany ..... 196 42 618

[51] Int. Cl.[6] ..... B65H 54/28

[52] U.S. Cl. ..... 242/477.2; 242/477.3; 242/477.9; 242/483.6

[58] Field of Search ..... 242/477.2, 477.3, 242/477.9, 483.6, 477.1, 483.5, FOR 192, FOR 195

[56] References Cited

U.S. PATENT DOCUMENTS

| | | | |
|---|---|---|---|
| 3,352,505 | 11/1967 | Parker | 242/477.3 |
| 3,690,579 | 9/1972 | Porter et al. | 242/477.2 |
| 4,383,653 | 5/1983 | Nakazawa et al. | 242/477.3 |
| 4,415,126 | 11/1983 | Nakazawa et al. | 242/477.3 |
| 4,544,113 | 10/1985 | Yoshinana et al. | 242/477.2 X |
| 4,767,071 | 8/1988 | Hirai | 242/477.2 |

FOREIGN PATENT DOCUMENTS

| | | |
|---|---|---|
| 2180179 | 11/1973 | France . |
| 2027 005 | 6/1970 | Germany . |
| 21 18 217 | 10/1971 | Germany . |
| 30 26 278 | 1/1981 | Germany . |
| 35 45 080 | 12/1985 | Germany . |
| 40 22 360 A1 | 1/1991 | Germany . |
| 1-313 264 | 6/1988 | Japan . |
| 3-205 267 | 1/1990 | Japan . |
| 681802 | 5/1993 | Switzerland . |

*Primary Examiner*—Michael Mansen
*Attorney, Agent, or Firm*—Thomas, Kayden, Horstemeyer & Risley

[57] ABSTRACT

An apparatus and method for winding a yarn in a wild winding onto a package, includes a reversing screwthread shaft (1) having an endless screwthread groove (2) and a yarn guide which produces in particular a creep stroke motion. The reversing screwthread shaft (1) has a turns number which establishes a double stroke having a forward stroke (3) and a reverse stroke (4) and which includes a mixed number and whose integral component is ≧2 and the balance of which represents a true fraction, and has on each side a plurality of reversals (5) which in particular are arranged in axially displaced relationship with each other. A half turns number which establishes a forward stroke (3) and a half turns number which establishes the associated reverse stroke (4) are the same.

12 Claims, 7 Drawing Sheets

0 1 2 3 4 5 6 7 8 9 10 11 12 13 14 15 16 17 18 19 20 21
4 1/5
8 2/5
12 3/5
16 4/5
1
2
2,3
3
4
5
7
8
9

APPARATUS AND METHOD FOR WINDING YARN IN A WILD WINDING ONTO A PACKAGE

FIELD OF THE INVENTION

The invention concerns an apparatus for winding a yarn in a wild winding onto a package, comprising a reversing screwthread shaft having an endless screwthread groove and a yarn guide which produces, in particular, a creep stroke motion, wherein the reversing screwthread shaft has a number of turns which establishes a double stroke comprising a forward stroke and a reverse stroke and which comprises a mixed number and whose integral component is ≧2 and the balance of which represents a true fraction, and has on each side a plurality of reversals which, in particular, are arranged in an axially displaced relationship with each other. With that wild winding the speed of rotation of the reversing screwthread shaft is constant due to the principle involved.

BACKGROUND OF THE INVENTION

An apparatus of the kind described in the opening part of this specification is known from DE 35 45 080 C2. In that arrangement the yarn guide is guided with a component of movement which can be generally referred to as a creep motion or edge control, thereby counteracting a build-up of the package in the edge regions. This also counteracts the formation of an image-type winding or a mirror-type formation at the periphery of the package. This is achieved by a reversing screwthread drum and a yarn guide, as well as by a control arrangement connected thereto for actuating the traversing yarn guide with a creep stroke motion. The reversing screwthread drum has an endless screwthread groove which guides the yarn to and fro a plurality of times so that a plurality of reversals are formed on each side of the reversing screwthread shaft. Those reversals are arranged in a mutually displaced relationship. No information is provided about the nature of the pitch or gradient of the screwthread groove. The illustration of an embodiment in the drawing shows a constant pitch or gradient. An embodiment of a reversing screwthread shaft is illustrated, in which the first double stroke has the turns number 7.4 and the second double stroke has the turns number 7.6. The integral component is thus greater than 2 and the balance represents a true fraction. Half the turns number which establishes a forward stroke of a double stroke and half the turns number which establishes the associated reverse stroke are respectively different. The control arrangement required for implementing the creep motion of the yarn guide signifies additional expenditure.

German laid-open applications (DE-OS) Nos. 21 18 217 20 27 005 disclose groove drums in which (FIGS. 1–3) a respective revolution of the groove drum produces the entire procedure of the program. With these embodiments, two double strokes or periods are produced for each groove drum. In the embodiments in FIG. 3, there are three double strokes per revolution. FIGS. 4 and 6 of DE-OS No. 20 27 005 show two embodiments in which the groove in the groove drum is of such a shape and arrangement that, for example, two periods are distributed over three revolutions of the groove drum. This arrangement therefore involves a true fraction as the relationship. FIGS. 5 and 7 of this publication also show two further embodiments in which the reversed relationship is used. Here, three periods are distributed over two revolutions and four periods over three revolutions, respectively, so that the relationship involves a mixed number whose integral component is equal to 1 and whose balance represents a true fraction. The pitch or gradient of the groove in the groove drum is substantially constant. Specific and deliberate shaping in the region of the reversals in the form of curve lines is intended to alleviate the edge build-up effect and to enhance the strength of the package.

The object of the invention is to provide an apparatus of the kind set forth in the opening part of this specification, that is to say an apparatus having a reversing screwthread shaft, in which image windings are reliably avoided, without additional control arrangements being required. In particular, the invention seeks to provide that this is possible in the case of a yarn guide with a creep stroke motion, that is to say the sweep or wobble effect is not to impede the production of a creep stroke motion.

SUMMARY OF THE INVENTION

In accordance with the invention in an apparatus of the kind described in the opening part of this specification, that is achieved in that a half turns number which establishes a forward stroke and a half turns number which establishes the associated reverse stroke are the same.

The number of turns which a screwthread groove of a reversing screwthread shaft requires or has in order to establish a double stroke, that is to say a forward stroke and a reverse stroke, is referred to as the turns number. Accordingly, for the forward stroke there is a half turns number and for the reverse stroke there is a half turns number. While in the case of the apparatus of the general kind set forth in the opening part of this specification those half turns numbers which afford a double stroke are established to be respectively different, that is to say they differ from each other, without however it being possible to ascertain what is to be achieved thereby, the invention is based on the notion of so designing the screwthread groove of the reversing screwthread shaft such that, within a double stroke comprising a forward stroke and a reverse stroke, the two half turns numbers are precisely the same or precisely correspond to each other. That should be the case at least at one location in the screwthread shaft, that is to say in the case of a double stroke. In addition, the total turns number must consist of a mixed number whose integral component is ≧2 and whose balance represents a true fraction. Those true fractions are then also the same. The screwthread groove of the reversing screwthread shaft always extends around the body of the reversing screwthread shaft in a plurality of turns but ultimately endlessly, that is to say blending into each other or adjoining each other. The turns number per double stroke is therefore no longer an integer. With the apparatus operating in this manner the yarn is not deposited at the reversals in mutually superposed relationship but is displaced over the periphery of the package at different reversal locations, to thereby counteract an edge build-up effect. The new apparatus can be used to produce packages which afford a reduced edge build-up effect and good stability so that they permit reliable and dependable handling.

The configuration of the screwthread groove of the reversing screwthread shaft can also be such that in each case a half turns number for establishing a forward stroke and a half turns number for establishing the associated reverse stroke are the same. That means that the half turns numbers of a double stroke are respectively the same. The turns numbers of a plurality of double strokes may be the same or may differ from each other.

The portions of the screwthread groove of the reversing screwthread shaft, that correspond to the forward strokes and reverse strokes, may involve different pitches or gradients and/or different reversal radii at axially displaced reversals. It is therefore possible to embody different pitches on the one hand and different reversal radii on the other hand. With constant pitches, the differences can be compensated by virtue of different reversal radii. Those reversal radii should always be of such a configuration as to afford an optimum, governed by the use involved. In that respect, the two mutually opposite requirements that the yarn should be deposited with as sharp an edge as possible on the one hand and the yarn guide should be guided in as rounded a fashion as possible at the reversals locations, must be taken into account. More specifically, the portions of the screwthread groove of the reversing screwthread shaft that correspond to the forward strokes and reverse strokes may have constant reversal radii at the reversals which are arranged in axially displaced relationship, and the portions of the screwthread groove of the reversing screwthread shaft, which correspond to the forward strokes, may have identical pitches while the portions corresponding to the reverse strokes have different pitches. The portions of the screwthread groove of the reversing screwthread shaft, which correspond to the forward strokes and reverse strokes, may have respectively different pitches.

There are further possible options. For each double stroke motion, the portions of the screwthread groove of the reversing screwthread shaft, which correspond to the forward strokes and the reverse strokes, may have the same turns numbers and different pitches per stroke movement.

It is also possible that the yarn guide does not have a creep stroke motion and thus has axially identically arranged reversals and that for each double stroke movement the portions of the screwthread groove of the reversing screwthread shaft, which correspond to the forward strokes and the reverse strokes, have identical turns numbers and identical pitches while there are different turns numbers and different pitches, from one double stroke motion to another.

Desirably, in all embodiments, all reversal radii are of the optimum configuration. That optimum reversal radius is always a compromise between the requirement in the winding art for a reversal of the laid yarn on the package, which affords a configuration with as sharp an edge as possible, and the requirements of the mechanical systems for gentle reversal of the yarn guide.

The screwthread groove of the reversing screwthread shaft may, for each side, also have more than two reversal points and more than two different turns numbers.

It is desirable for a sweep or wobble movement without an ancillary arrangement if the screwthread groove of the reversing screwthread shaft is asymmetrical in regard to the turns number of a double stroke movement or a plurality of double stroke movements.

BRIEF DESCRIPTION OF THE DRAWINGS

The invention is further described and explained by means of preferred embodiments. In the drawing.

DETAILED DESCRIPTION

Figure 1:
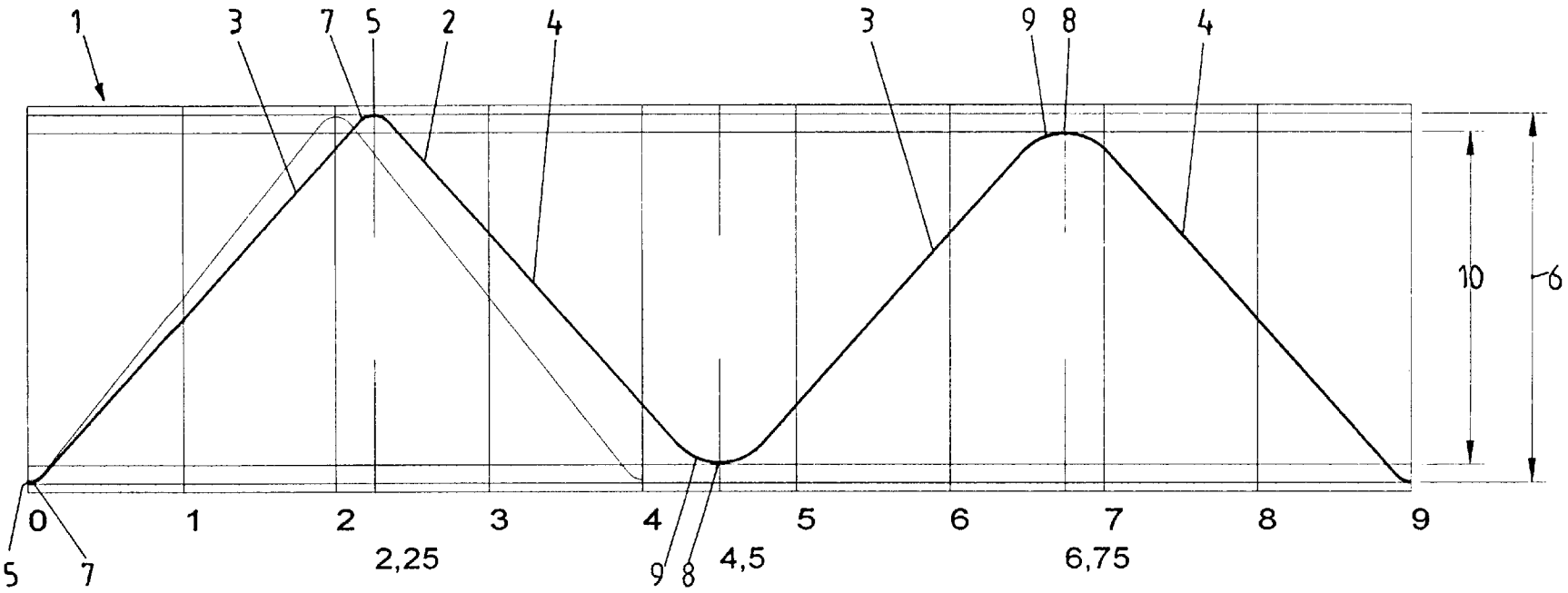
FIG. 1 shows the development of the screwthread groove of a reversing screwthread shaft with a turns number of 2×4.5.

FIG. 1 shows the development of a reversing screwthread shaft with a screwthread groove 2 shown in heavy lines. The revolutions of the reversing screwthread shaft 1 are indicated on the abscissa. The turns number is 2×4.5 so that after nine revolutions of the reversing screwthread shaft 1 the screwthread groove 2 goes back to its beginning again. For comparison, shown in thin lines is the double stroke movement of a reversing screwthread shaft with four turns, that is to say the turns number 4. Each double stroke movement breaks down into a forward stroke 3 and a reverse stroke 4. Starting from the point 0 the forward stroke 3 extends over 2.25 revolutions of the reversing screwthread shaft 1. That forward stroke 3 begins and ends in an outer reversal point 5 and thus represents the nominal stroke 6 of the yarn guide. It can be seen that the reversal radii 7 are relatively small. As a result of the half turns number of 2.25 of the forward stroke 3, the screwthread groove 2, in the region of that forward stroke 3, has a gradient or pitch which differs from the gradient or pitch of a conventional reversing screwthread shaft with four turns. The reverse stroke 4 of the first double stroke movement, which is associated with the forward stroke 3, also extends over 2.25 turns from 2.25 to 4.5. The reverse stroke begins at the reversal 5 and terminates at the reversal 8 which is axially displaced somewhat with respect to the reversal 5 and is of a comparatively larger reversal radius 9.

Between 4.5 and 9 revolutions of the reversing screwthread shaft 1 there is the second double stroke movement with a turns number of 4.5. This double stroke movement also comprises a forward stroke 3 and a reverse stroke 4, between which there is once again a reversal 8 which is axially displaced with respect to the nominal stroke movement, with a comparatively larger reversal radius 9. The reverse stroke 4 of the second double stroke movement terminates at nine revolutions of the reversing screwthread shaft and thus makes the transition into the beginning of the forward stroke 3 of the first double stroke movement. The two reversals 8 afford the shortened stroke 10.

The screwthread groove 2 of the reversing screwthread shaft 1 as shown in FIG. 1 is such that the pitches of the forward strokes 3 and the reverse strokes 4 are constant. There is the same pitch in all four strokes. The shortened position of the reversals 8 is compensated or made possible by virtue of suitable reversal radii. With such a reversing screwthread shaft 1, it is possible to implement a program in the sequence long, short, short, long.

It is a common aspect of all the Figures of the drawings that only one single-bobbin reversing screwthread shaft 1 is illustrated in each thereof and it will be appreciated that a plurality of such reversing screwthread shafts can be arranged in axial succession.

In regard to the first double stroke movement the reversing screwthread shaft 1 requires 2.25 revolutions in order to cover the first forward stroke 3. It requires a further 2.25 revolutions in order to achieve the first associated reverse stroke 4. The same applies for the second double stroke movement. The half turns numbers of all forward and reverse strokes are 2.25 and are thus the same. Accordingly the screwthread groove 2 provides for guidance of a yarn guide with a creep movement. In addition the reversals are arranged displaced relative to each other over the periphery through 90° in each case.

Figure 2A:
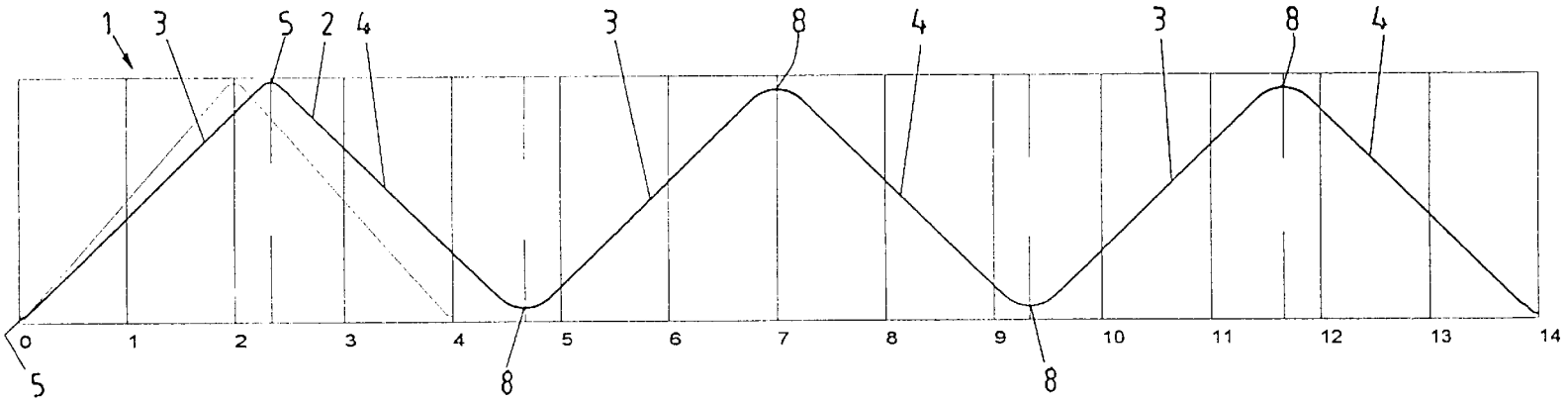
FIGS. 2*a* and 2*b* show the development of two reversing screwthread shafts with a turns number of 3×42/3.
Figure 2B:
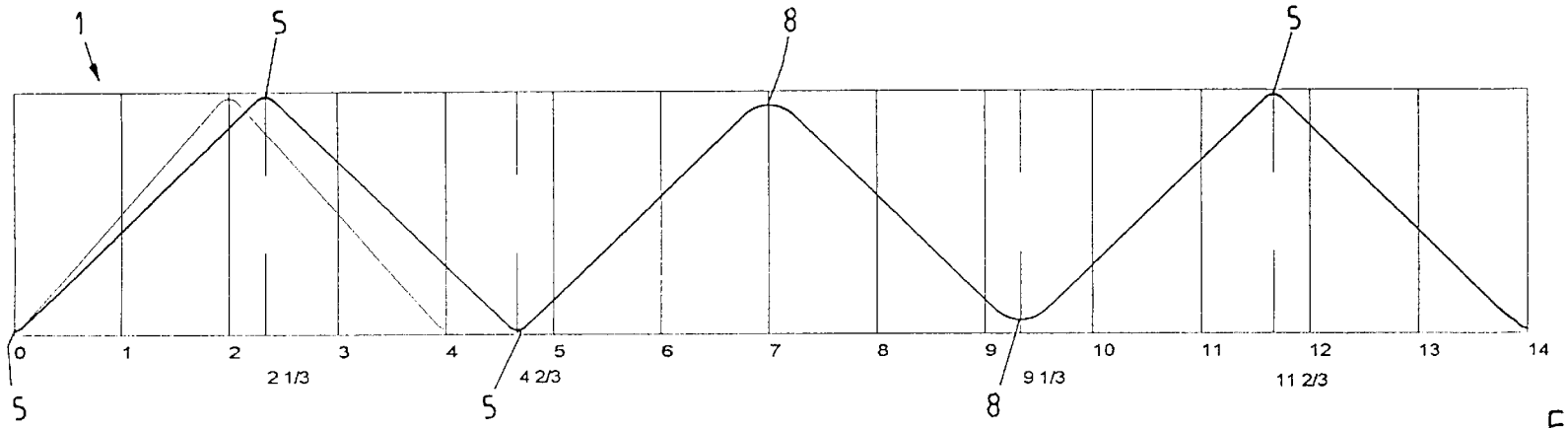

FIGS. 2*a* and 2*b* show a second embodiment with two possible forms of a single-bobbin reversing screwthread shaft 1 with 3×42/3 turns in two different possible uses. The screwthread groove 2 is clearly emphasised. For comparison once again, the configuration of a reversing screwthread shaft with four turns is indicated in thinner lines. In FIG. 2*a* there are only two reversals 5, that is to say an outer reversal 5 on each side, which define the nominal stroke 6. Otherwise there are four shortened reversals 8 and these once again have comparatively enlarged reversal radii. That gives a bobbin construction which is of a comparatively softer and gentler nature at the outside.

The situation is reversed in FIG. 2*b*. Here there are four outwardly disposed reversals 5 and two inwardly disposed reversals 8 so that the outer edge of the bobbin is comparatively harder. The pitch is constant.

Figures 3A, 3B, 3C:
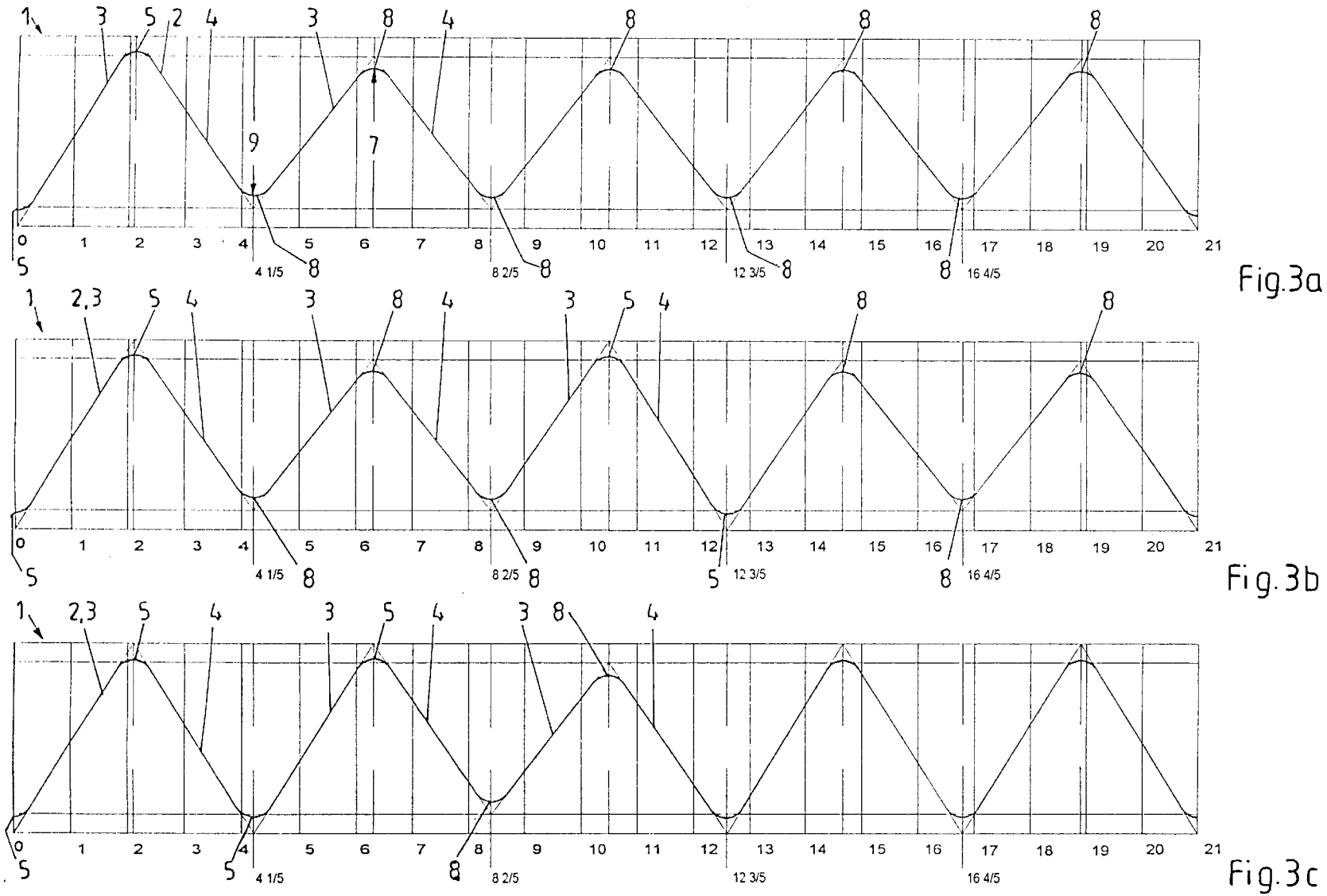
FIGS. 3*a* –3*b* show the development of three reversing screwthread shafts with a turns number of 5×51/5.

FIGS. 3*a*–3*c* show three out of four possible embodiments of a single-bobbin reversing screwthread shaft 1 with 5×51/5 turns. In FIG. 3*a,* for each side there is provided only one outwardly disposed reversal 5 and four shortened reversals 8. FIG. 3*b* shows for each side two outwardly disposed reversals 5 and three shortened reversals 8. In FIG. 3*c* the outwardly disposed reversals are emphasised. Here there are four outward reversals 5 per side and only one inward reversal 8 per side. These embodiments show that the pitches of the portions of the screwthread groove 2 in the forward stroke 3 and in the reverse stroke 4 can be selected to be different. The reversal radii 7 and 9 may also be chosen to be respectively different. In general a constant pitch will be combined with different radii. Conversely slightly different pitches in combination with optimised reversal radii 5, 8 which are then the same are also appropriate.

Figure 4:
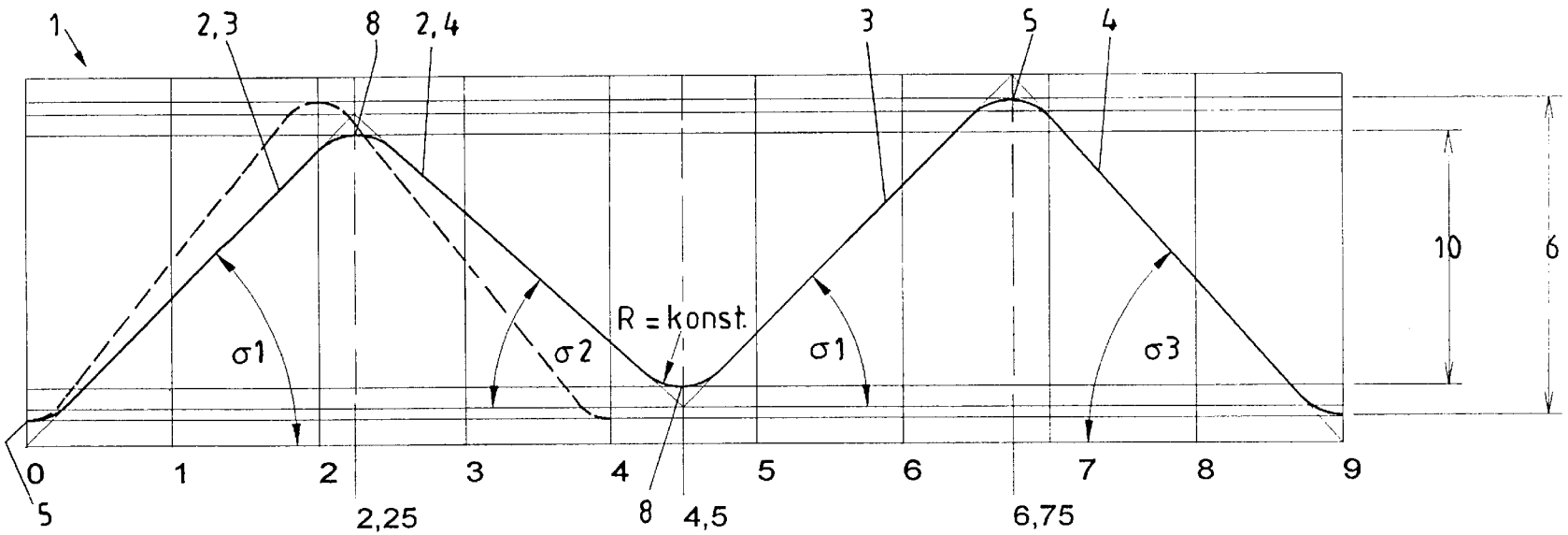
Figure 4 shows the development of a reversing screwthread shaft with a turns number of 2×4.5, similarly to FIG. 1, but with different pitch angles in the forward and reverse strokes.

FIG. 4 shows an embodiment of the reversing screwthread shaft 1 in which the reversal radii 7 and 9 are equal and constant in the region of the reversals 5 and 8. The pitch angles σ1, σ2 and σ3 are respectively different. The two forward strokes 3 of the two double stroke movements have the same pitch angle σ1 while the reverse strokes 4 of the two double strokes have different pitch angles σ2 and σ3 respectively. With a screwthread groove 2 or reversing screwthread shaft 1 of such a configuration it is possible to achieve a sweep or wobble effect without any ancillary apparatus so that image-type and mirror-type windings are avoided. As will be apparent, layers which are deposited in different ways are produced on the package in each respective double stroke movement, that is to say the layer which is just being deposited differs from the respectively precedingly deposited layer.

Figure 5:
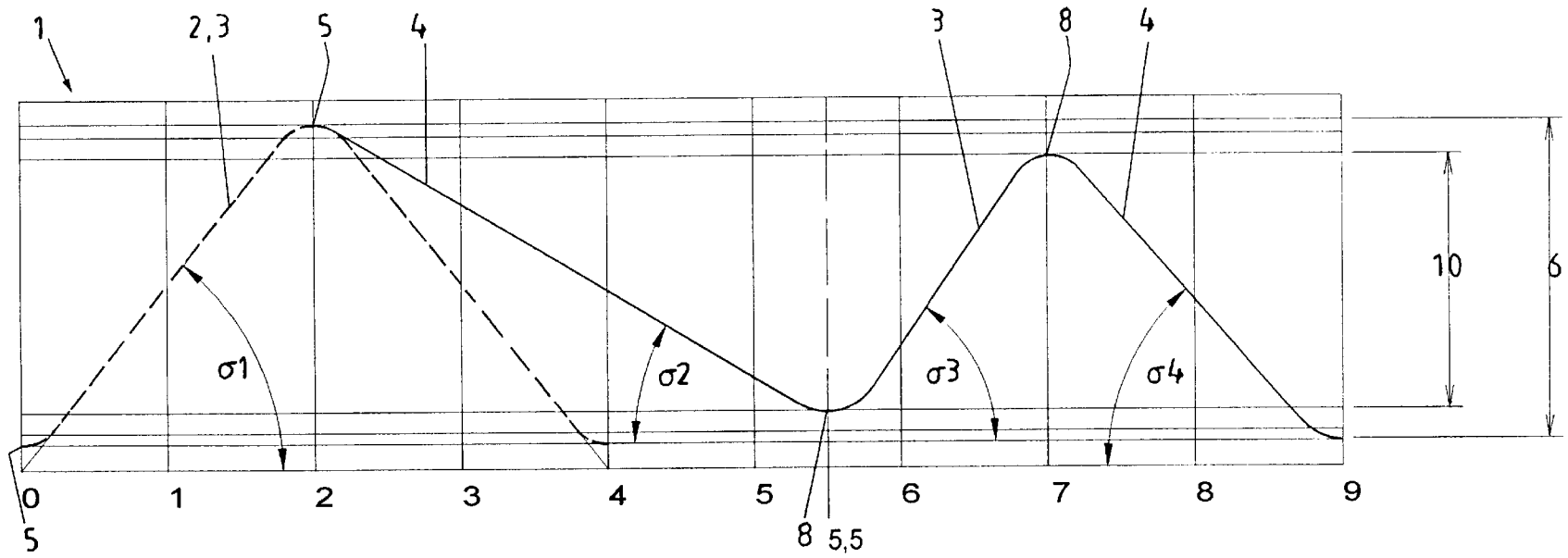
FIG. 5 shows the development of a reversing screwthread shaft with a path of a turns number of 5.5 in the first double stroke and 3.5 in the second double stroke.

The embodiment shown in FIG. 5 is even more suitable for avoiding image-type windings on the package. Shown therein is a reversing screwthread shaft 1 with a screwthread groove 2 in which the first double stroke movement has a turns number of 5.5 and the second double stroke movement has a turns number of 3.5. In addition, respectively different pitches σ1, σ2, σ3 and σ4 are used in the four stroke movements. The reverse stroke 4 of the second double stroke movement adjoins the forward stroke 3 of the first double stroke movement. Both strokes use a half turns number of 2 so that the condition of claim 1 is satisfied thereby. By virtue of the asymmetric construction, that reversing screwthread shaft 1 is even better suited to avoiding image-type winding configurations.

Figure 6:
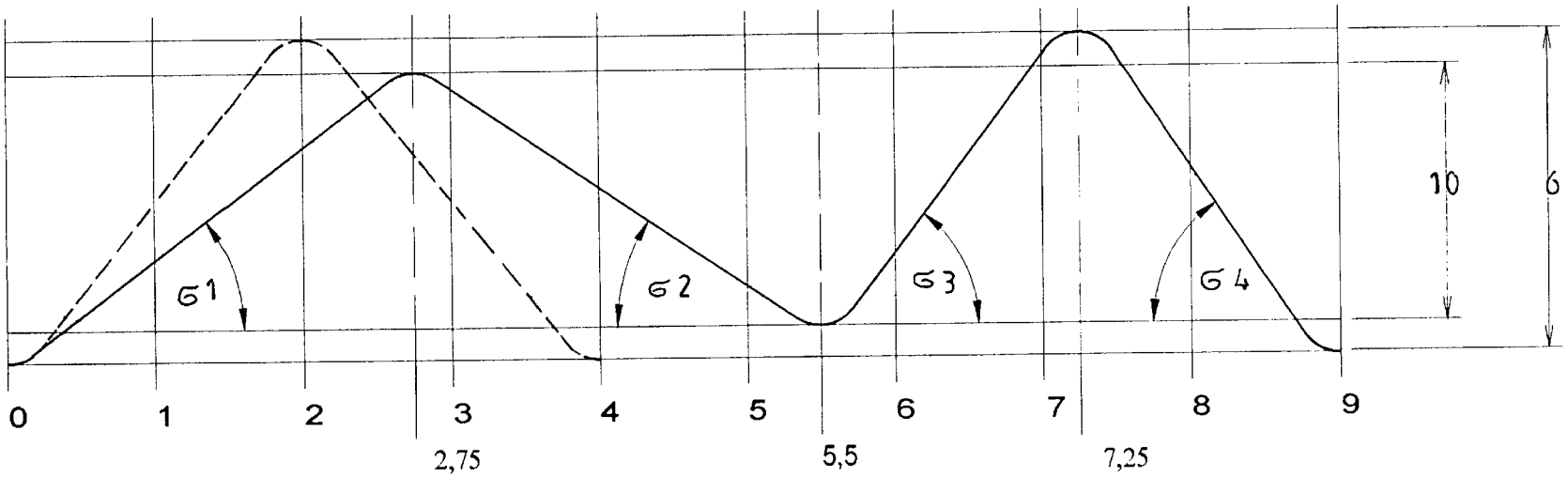
FIG. 6 shows the development of a reversing screwthread shaft with respectively different pitches in the region of the portions of the screwthread groove.

The embodiment of FIG. 6 also has a screwthread groove 2 with a first double stroke movement with a turns number of 5.5 and a second double stroke movement with a turns number of 3.5. Respectively different pitches σ1, σ2, σ3 and σ4 are used. The first half turns number is the same as the second half turns number and is 2.75. The third turns number and the fourth turns number of the second double stroke movement are the same and are each 1.75. Approximately identical conditions are afforded for each double stroke movement. Once again image-type winding configurations are avoided in the succession of the double stroke movements.

Figure 7:
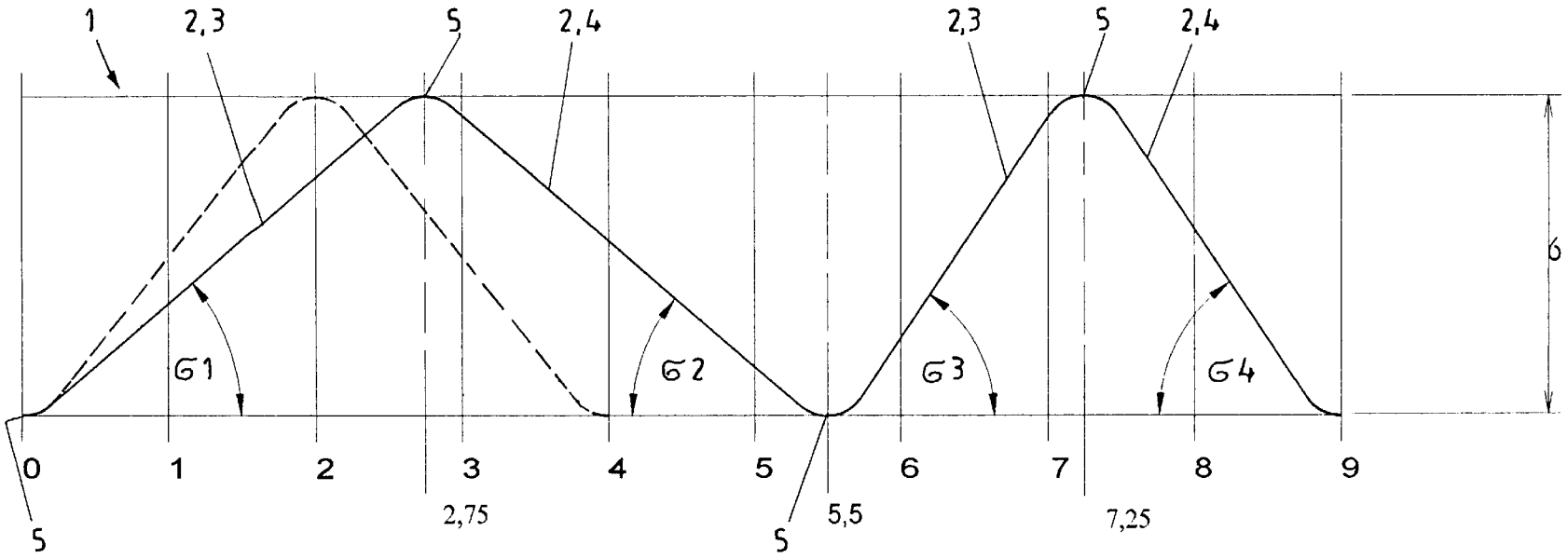
FIG. 7 shows the development of a reversing screwthread shaft without creep motion but with wobble effect.

Finally FIG. 7 shows an embodiment only with a wobble effect and without a creep motion. Consequently there is only the nominal stroke 6 and only the reversals 5. The same pitches are used for each double stroke movement, that is to say σ1=σ2. In the second double stroke movement also the pitch σ3 corresponds to the pitch σ4. The pitches of different double stroke movements are different, that is to say σ2 is not equal to σ3. The half turns number per double stroke movement are the same, that is to say w1=w2=2.75. Also w3=w4=1.75.

While the foregoing specification and drawing set forth preferred embodiments of the invention, it will be understood that variations and modifications thereof can be made without departing from the spirit and scope of the invention as set forth by the following claims.

I claim:

1. An apparatus for winding a yarn onto a package, said apparatus comprising:

a reversing screwthread shaft having an endless screwthread groove which includes a plurality of yarn guide reversals, said endless screwthread groove having groove portions which correspond to forward yarn guide strokes and groove portions which correspond to reverse yarn guide strokes, said endless screwthread groove being configured so as to have a turns number that comprises an integer component that is equal to or greater than 2 and a remainder that is a true fraction and further being configured so as to have a half turns number associated with a forward stroke that is equal to a half turns number associated with a reverse stroke; and a yarn guide for guiding the yarn onto the package, said yarn guide being configured to follow said endless screwthread groove to complete forward and reverse strokes.

2. An apparatus as set forth in claim 1, wherein said reversing screwthread shaft and said yarn guide are configured so as to produce a creep stroke motion.

3. An apparatus as set forth in claim 1, wherein the number of turns completed by said shaft during one forward stroke is equal to that completed during the reverse stroke that immediately follows said forward stroke.

4. An apparatus as set forth in claim 1, wherein the portions of said screwthread groove of said reversing screwthread shaft which correspond to the forward strokes and the portions of said screwthread groove which correspond to the reverse strokes have different pitches, respectively.

5. An apparatus as set forth in claim 4, wherein the portions of said screwthread groove of said reversing screwthread shaft which correspond to the forward strokes and the portions of said screwthread groove which correspond to the reverse strokes have constant reversal radii at said reversals, respectively, and the portions of the screwthread groove of said reversing screwhread shaft which correspond to said forward strokes all have the same pitches while the portions of said reversing screwthread shaft which correspond to the reverse strokes all have different pitches.

6. An apparatus as set forth in claim 1, wherein the portions of said screwthread groove of said reversing screwthread shaft which correspond to the forward strokes and the portions of said screwthread groove which correspond to the reverse strokes have different reversal radii at said reversals, respectively.

7. An apparatus as set forth in claim 1, wherein for each double stroke movement the portions of said screwthread groove of said reversing screwthread shaft which correspond to the forward strokes and the portions of said screwthread groove which correspond to the reverse strokes have identical turns numbers and pitches which are different, respectively, for each stroke movement.

8. An apparatus as set forth in claim 1, wherein for each double stroke movement the portions of said screwthread groove of said reversing screwthread shaft which correspond to the forward strokes and the portions of said screwthread groove which correspond to the reverse strokes have the same turns number and the same pitches, respectively, each sequential double stroke having a different turns number and a different pitch from the next.

9. An apparatus as set forth in claim 1, wherein all reversal radii are of optimum configuration.

10. An apparatus as set forth in claim 1, wherein said screwthread groove of said reversing screwthread shaft is of an asymmetrical configuration in regard to the turns number of at least one double stroke movement.

11. An apparatus as set forth in claim 1, wherein said screwthread groove of said reversing screwthread shaft is of an asymmetrical configuration in regard to the turns number of a plurality of double stroke movements.

12. A method for winding a yarn onto a package, said method comprising the steps of:

guiding a yarn guide along an endless screwthread groove formed in a reversing screwthread shaft, the endless screwthread groove including a plurality of reversals and having groove portions which correspond to forward yarn guide strokes and groove portions which correspond to reverse yarn guide strokes; and rotating the reversing screwthread shaft in a manner in which the shaft completes a predetermined number of turns each time the yarn guide completes both a forward stroke and a reverse stroke, the predetermined number having an integer component that is equal to or greater than 2 and a remainder that is a true fraction, wherein the number of turns completed by the shaft during at least one forward stroke is equal to the number of turns completed by the shaft during at least one reverse stroke.

* * * * *